US006012513A

United States Patent [19]

Iokawa et al.

[11] Patent Number: 6,012,513

[45] Date of Patent: Jan. 11, 2000

[54] HEAT EXCHANGER

[75] Inventors: Hiroshi Iokawa; Yoshifusa Tobata, both of Nishi-kasugai-gun, Japan

[73] Assignee: Mitsubishi Heavy Industries, LTD, Tokyo, Japan

[21] Appl. No.: 09/088,078

[22] Filed: Jun. 1, 1998

[30] Foreign Application Priority Data

Jun. 2, 1997 [JP] Japan ..... 9-143587

[51] Int. Cl.[7] ..... F28F 9/02

[52] U.S. Cl. ..... 165/149; 165/173; 165/906

[58] Field of Search ..... 165/149, 173, 165/906

[56] References Cited

U.S. PATENT DOCUMENTS

| | | | |
|---|---|---|---|
| 5,052,479 | 10/1991 | Nakajima et al. | 165/153 |
| 5,101,887 | 4/1992 | Kado | 165/76 |
| 5,265,672 | 11/1993 | Aoki | 165/149 |
| 5,289,873 | 3/1994 | Ryan et al. . | |
| 5,535,819 | 7/1996 | Matsuura . | |
| 5,662,162 | 9/1997 | Fukuoka et al. . | |

FOREIGN PATENT DOCUMENTS

| | | | |
|---|---|---|---|
| 3937463 | 5/1990 | Germany | 165/149 |
| 4120869A1 | 1/1993 | Germany . | |
| 2-10285 U | of 0000 | Japan . | |
| 4-244596 | of 0000 | Japan . | |
| 4-59426 | of 0000 | Japan . | |
| 5-248783 | 9/1993 | Japan | 165/149 |

*Primary Examiner*—Allen Flanigan
*Attorney, Agent, or Firm*—Birch, Stewart Kolasch & Birch, LLP

[57] ABSTRACT

To provide a heat exchanger capable of installing the side plate to the header pipe accurately without improper joining and errors respectively is disclosed. In a heat exchanger in which both end portions of the side plate are inserted into end portions of a pair of header pipes respectively, a large number of tubes are provided between the header pipes between the side plates, and fins are provided between the large number of tubes, a pair of pawls for pinching the header pipe wall therebetween are provided on both sides of both end portions of the side plates respectively so that the pair of pawls regulate the angle of installation and the insertion position of the side plate to the header pipe. This enables the side plate to be accurately installed to the header pipes in a state free from improper joining and errors, and the header pipes are accurately positioned, thus eliminating any possibility of causing obstruction to piping or the like.

18 Claims, 5 Drawing Sheets

HEAT EXCHANGER

BACKGROUND OF THE INVENTION

The present invention relates to a heat exchanger for an air conditioner, for example, a heat exchanger for a car air conditioner.

With reference to FIGS. 6 and 7, the description will be made of a conventional heat exchanger for a car air conditioner. FIG. 6 shows the visual appearance state of the heat exchanger, and FIG. 7 shows a cross-section taken on line VII—VII in FIG. 6.

As shown in FIG. 6, in a heat exchanger 1, two upper and lower side plates 4 and 4 are provided between a pair of tube-shaped header pipes 2 and 3 (left-side header 2 and right-side header 3) made of aluminum, and both ends of the side plates are inserted into the left-side header pipe 2 and the right-side header pipe 3 respectively and brazed.

A plurality of tubes 5 are arranged between the side plates 4 and 4, and the both ends of the tubes 5 are braze joined with the left-side header pipe 2 and the right-side header pipe 3 respectively. Refrigerant flows through the inside of the tubes 5. Corrugated fins 6 are brazed between each tube 5, and the fins 6 are formed by a thin plate made of aluminum.

In the upper part of the right-side header pipe 3, there is provided an inlet pipe 7 for refrigerant gas, through which the interior of the right-side header pipe 3 is filled with refrigerant gas. The interior of the right-side header pipe 3 is partitioned into two parts, upper and lower, by a partition plate 8, and an outlet pipe 9 for discharging refrigerant liquid is provided in the lower part of the right-side header pipe 3. The inlet pipe 7 is connected to a compressor (not shown) and the outlet pipe 9 is connected to an evaporator (not shown).

The refrigerant gas compressed by a compressor (not shown) is supplied into the upper part (above the partition plate 8) of the right-side header pipe 3 through the inlet pipe 7, and flows inside the plurality of tubes 5. While the refrigerant gas is flowing inside the tube 5, air flows between the fins 6 by a fan (not shown) to cool the fins 6.

The refrigerant gas inside the tubes 5 is heat-exchanged (cooled) by the fins 6 to be liquefied, and flows into the left-side header pipe 2. The refrigerant inside the left-side header pipe 2 flows on the right side in FIG. 6 inside the plurality of tubes 5 below to be cooled by the fins 6 again, and is completely liquefied to flow below (below the partition plate 8) the right-side header pipe 3. The refrigerant liquid which has flowed below the right-side header pipe 3 is discharged to the evaporator (not shown) through the outlet pipe 9.

On assembling the heat exchanger 1, the both ends of the side plate 4 are adapted to be brazed after they are installed to the left-side header pipe 2 and the right-side header pipe 3 in a predetermined state respectively. On installing the side plate 4, one end portion of the side plate 4 is inserted into a slit hole 10 in the left-side header 2 as shown in FIG. 7 for being brazed. The other end portion of the side plate 4 is also installed to the right-side header pipe 3 in the same manner.

In a conventional heat exchanger 1, both ends of the side plate 4 are adapted to be installed to the left-side header pipe 2 and the right-side header pipe 3 in a predetermined state by inserting the end portion of the side plate 4 into the slit hole 10 in the left-side header pipe 2 (right-side header pipe 3).

Since, however, the width of the slit hole 10 is set to be larger than the width of the end portion of the side plate 4, there arises a clearance between the slit hole 10 and the end portion of the side plate 4. The occurrence of the clearance causes errors to angles of installing the side plate 4 to the left-side header pipe 2 and the right-side header pipe 3, and particularly to the positions of the inlet pipe 7 and the outlet pipe 9 of the right-side header pipe 3. This causes obstruction to the piping of the heat exchanger 1, and if the errors are great, there has been a possibility that the heat exchanger 1 could not be assembled.

Also, since the depth in inserting the end portion of the side plate 4 is not regulated, if the side plate 4 is inserted deep in one header pipe, for example, the left-side header pipe 2 side, the depth of insertion on the right-side header pipe 3 side will become exceedingly small, possibly leading to incomplete fixation even if brazed.

SUMMARY OF THE INVENTION

The present invention has been achieved in the light of the above-described state of affairs, and is aimed to provide a heat exchanger capable of installing the side plate to the header pipe without errors and accurately.

In order to achieve the above-described object, the structure according to the present invention is characterized in that in a heat exchanger, in which both ends of the side plates are inserted into the end portions of a pair of headers pipes respectively, a large number of tubes are provided between the pair of headers pipes between the respective side plates, and fins are arranged between the large number of tubes, position regulating means for regulating the inserted state of the side plate into the header pipe is provided between the pair of header pipes and the both end portions of the side plates respectively.

The position regulating means is characterized by being a pair of pawls formed by a bent portion of the side plates and provided on both sides of both end portions of the side plate respectively, for pinching the header wall therebetween.

Also, the position regulating means are characterized by comprising pawls formed by a bent portion of the side plates and provided on both sides of both end portions of the side plate respectively, for abutting on the inner wall of the header pipe, and a convex portion provided in the middle of both sides of both end portions of the side plate, for abutting on the outer wall of the header pipe to pinch the header wall with the pawls.

In order to achieve the object, the structure according to the present invention is further characterized in that in a heat exchanger, in which a pair of side plates have first and second end portions, respectively; a pair of header pipes connected to the first and second end portions of the side plates, respectively; a plurality of tubes provided between the pair of side plates and the pair of header pipes; and position regulating means for regulating the connection between the pair of header pipes and the pair of side plates, wherein:

the end portions of the side plates are inserted into slit holes provided in the pair of header pipes, the position regulating means includes two pairs of pawls at each end portion of the pair of side plates, respectively, the pawls are formed by bent portions of the side plates.

In order to achieve the object, the structure according to the present invention is still further characterized in that in a heat exchanger, in which the two pairs of pawls further comprise a first pair of pawls on an inside surface of a wall of each of the pair of header pipes, respectively, and a second pair of pawls on an outside surface of the wall of each of the pair of header pipes, respectively, the first and second pairs of pawls pinching the wall of each of the pair of header pipes therebetween, wherein:

the position regulating means includes a pair of pawls and a convex portion at each end portion of the pair of side plates, respectively, the pawls are formed by bent portions of the side plates, the pair of pawls is on an inside surface of a wall of each of the pair of header pipes, respectively, and the convex portion is on an outside surface of the wall of each of the pair of header pipes, respectively, the pair of pawls and the convex portion pinching the wall of each of the pair of header pipes therebetween.

BRIEF DESCRIPTION OF THE DRAWINGS

These and other objects, advantages, features, and uses will become more apparent as the description proceeds, when considered with the accompanying drawings in which.

DETAILED DESCRIPTION OF THE PREFERRED EMBODIMENT

Figure 1:
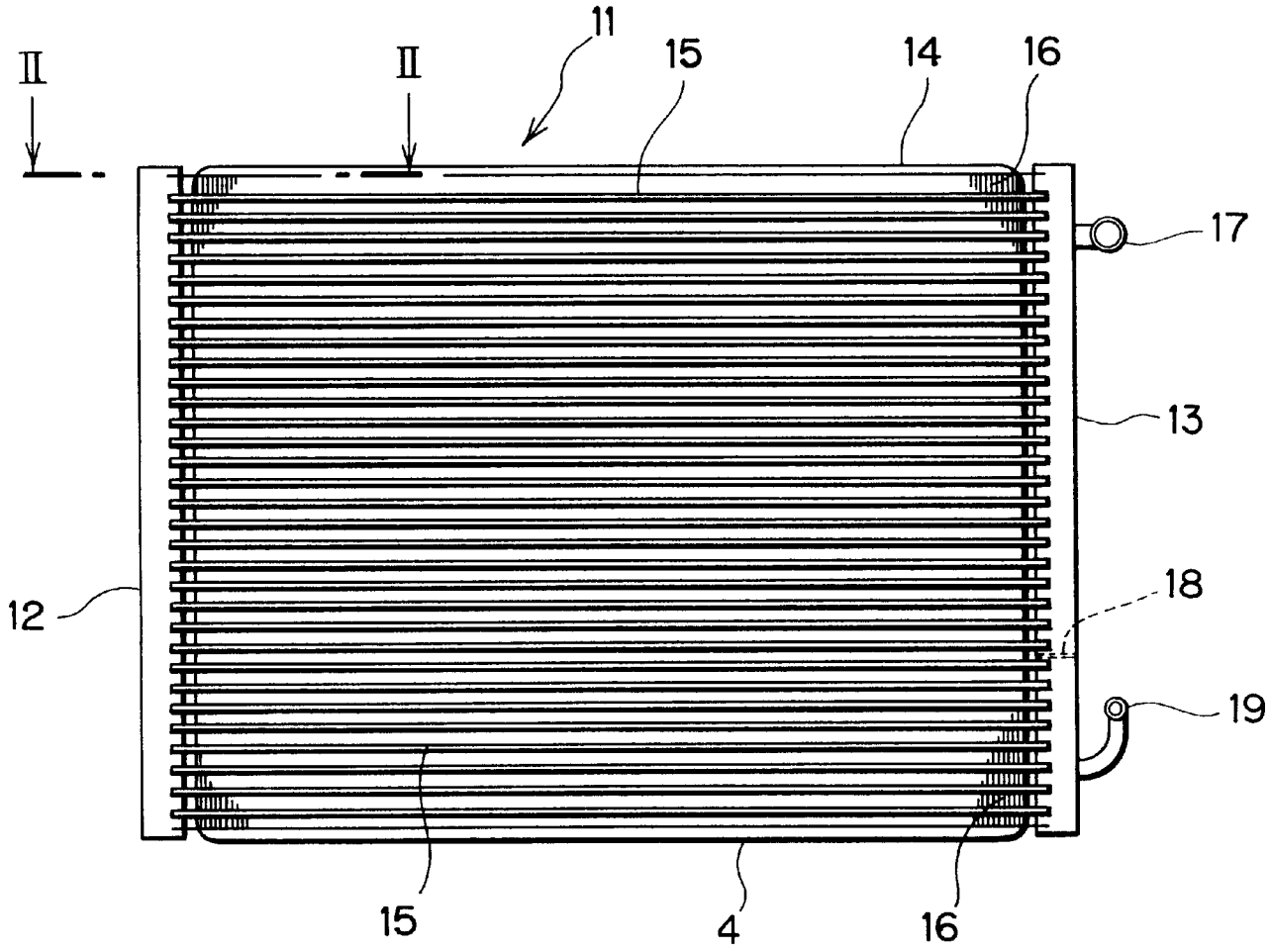
FIG. 1 is an outside drawing showing a heat exchanger according to an embodiment of the present invention.

In a heat exchanger 11, as shown in FIG. 1, two upper and lower side plates 14 and 14 are provided between a pair of tube-shaped header pipes 12 and 13 made of aluminum (left-side header pipe 12 and right-side header pipe 13), and both ends of the side plate 14 are inserted into the left-side header pipe 12 and the right-side header pipe 13 respectively for being brazed.

Between the side plates 14 and 14, there are arranged a large number of tubes 15, in which refrigerant flows through, and both ends of the tubes 15 are brazed with the left-side pipe 12 and the right-side header pipe 13 respectively. Between each tube 15, fins 16, each prepared by bending a thin plate made of aluminum in a corrugated shape are braze joined.

In the upper part of the right-side header 13, there is provided an inlet pipe 17 for refrigerant gas, and the interior of the right-side header pipe 13 is partitioned into two parts: and down by a partition plate 18. In the lower part of the right-side header pipe 13, there is provided an outlet pipe 19 for discharging refrigerant liquid. The inlet pipe 17 is connected to a compressor (not shown), and the outlet pipe 19 is connected to an evaporator (not shown).

The refrigerant gas compressed by the compressor (not shown) is supplied into the upper part (above the partition plate 18) of the right-side header pipe 13 through the inlet pipe 17, and flows inside the plurality of tubes 15. While the refrigerant gas is flowing inside the tubes 15, air is caused to flow between the fins 16 by a fan (not shown) to cool the fins 16.

The refrigerant gas inside the tubes 15 is heat exchanged (cooled) by the fins 16 to be liquefied, and flows into the left-side header pipe 12. There fragrant inside the left-side header 12 flows to the right in FIG. 1 inside a plurality of tubes 15 below to be cooled by the fins 16 again, and is completely liquefied to flow below the right-side header 13 (below the partition plate 18). The refrigerant liquid which has flowed below in the right-side header pipe 13 is discharged into an evaporator (not shown) through the outlet pipe 19.

The installed state of the side plate 14 will be described with reference to FIGS. 2 and 3. In this respect, these figures show the relationship between the left-side header pipe 12 and the side plate 14, and the relationship between the right-side header pipe 13 and the side plate 14 is also the same, and therefore, the description thereof is omitted.

Figure 2:
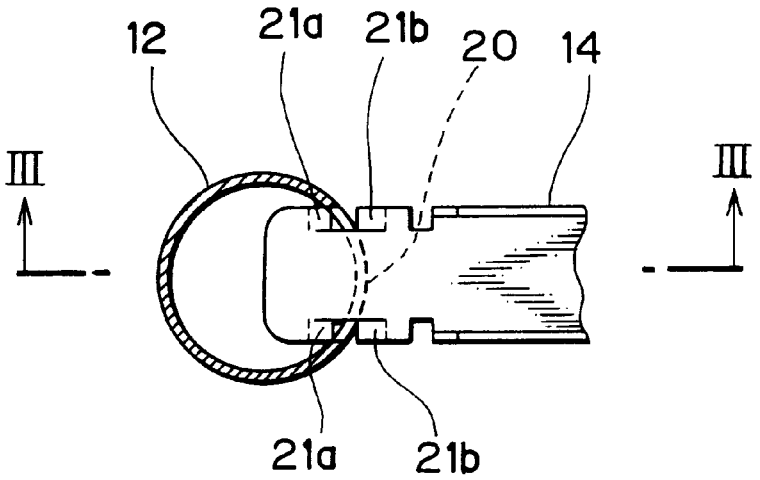
FIG. 2 is a cross-sectional view taken on line II—II in FIG. 1.
Figure 3:
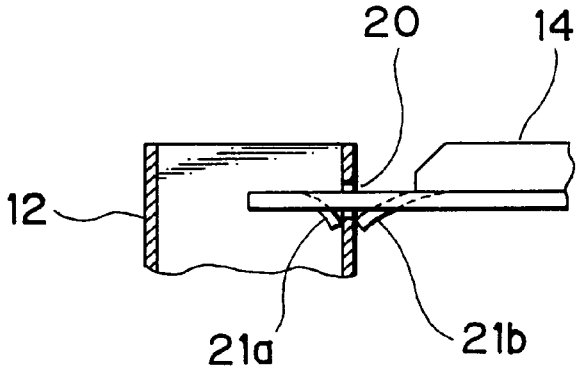
FIG. 3 is a cross-sectional view taken on line III—III in FIG. 2.

As shown in FIGS. 2 and 3, on assembling a heat exchanger 11, the both ends of the side plate 14 are inserted into the slit hole 20 in the left-side header pipe 12 (right-side header 13) for being brazed. Since the positional relationship between both ends of the side plate 14 and the slit holes 20 is regulated by the position regulating means, the side plate 14 can be installed to the left-side header pipe 12 and the right-side header pipe 13 without errors.

More specifically, on both sides of both ends of the side plate 14, there are formed a pair of pawls 21*a* and 21*b* as the position regulating means respectively. When both end portions of the side plate 14 are inserted into the slit holes 20 in the left-side header pipe 12 and the right-side header pipe 13 respectively, the respective pair of pawls 21*a* and 21*b* on both sides are bent to pinch the pipe walls of the left-side header 12 and the right-side header pipe 13 therebetween respectively.

Since the left-side header pipe 12 and the right-side header pipe 13 are pinched between the pair of bent tabs or pawls 21*a* and 21*b* provided on both sides of both end portions of the side plate 14 respectively, the pipe wall is pinched at two places on both sides of both end portions of the side plate 14. To this end, the angles of installation of the side plate 14 to the left-side header pipe 12 and the right-side header pipe 13 are regulated by pinching the pipe wall between the pair of pawls 21*a* and 21*b* at two places at each end portion. Also, the insertion depth of the side plate 14 to the slit hole 20 is regulated by pinching the pipe wall between the pair of pawls 21*a* and 21*b* at two places of each end portion. This enables the side plate 14 to be installed to the left-side header pipe 12 and the right-side header pipe 13 in a state free from errors.

The upper and lower side plates 14 are installed to the left-side header pipe 12 and the right-side header pipe 13 using the pair of pawls 21*a* and 21*b*, and the tubes 15 and the fins 16 are installed, and then they are placed in an oven for being brazed to constitute a heat exchanger 11.

In the above-described heat exchanger 11, the angles of installation and the insertion depth of the side plate 14 to the left-side header pipe 12 and the right-side header pipe 13 are regulated by pinching the pipe wall between the pair of pawls 21*a* and 21*b* at two places of each end portion of the side plate 14. Therefore, it is not necessary to confirm the insertion depth, but the input pipe 17 and the outlet pipe 19 can be accurately positioned in a state free from any improper joining. Accordingly, the improper joining will be eliminated, and no obstruction will be caused to the piping in the heat exchanger 11.

Figure 4:
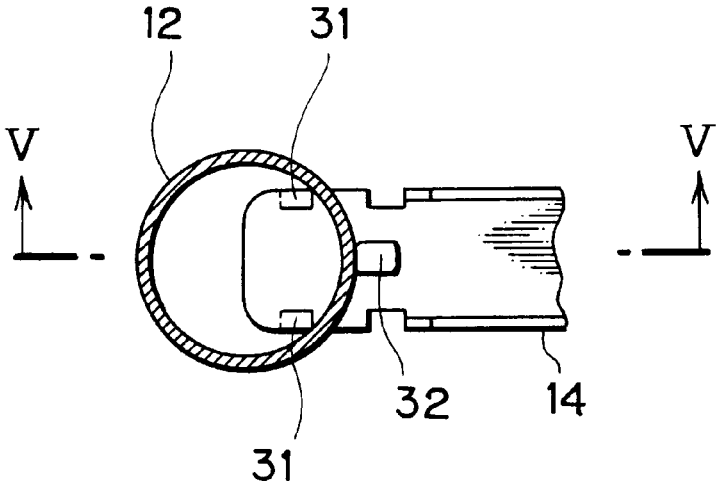
FIG. 4 is a block diagram of principal part showing position regulating means according to another embodiment.
Figure 5:
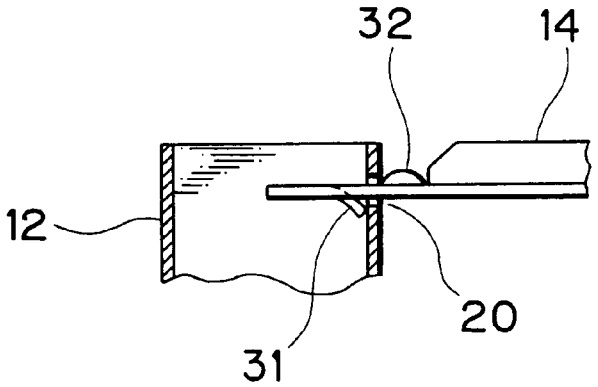
FIG. 5 is across-sectional view taken on line V—V in FIG. 4.
Figure 6:
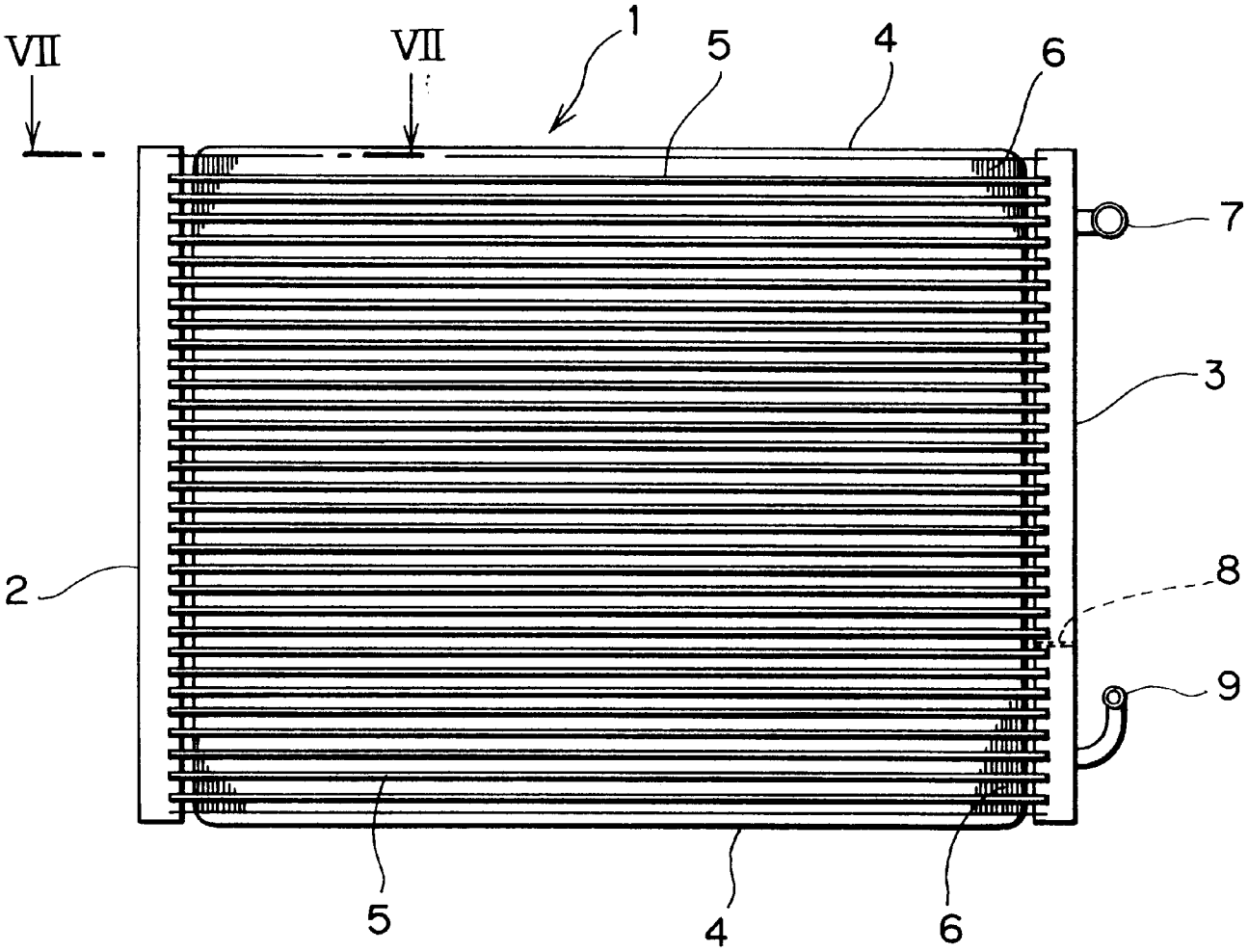
FIG. 6 is an outside drawing showing a conventional heat exchanger.
Figure 7:
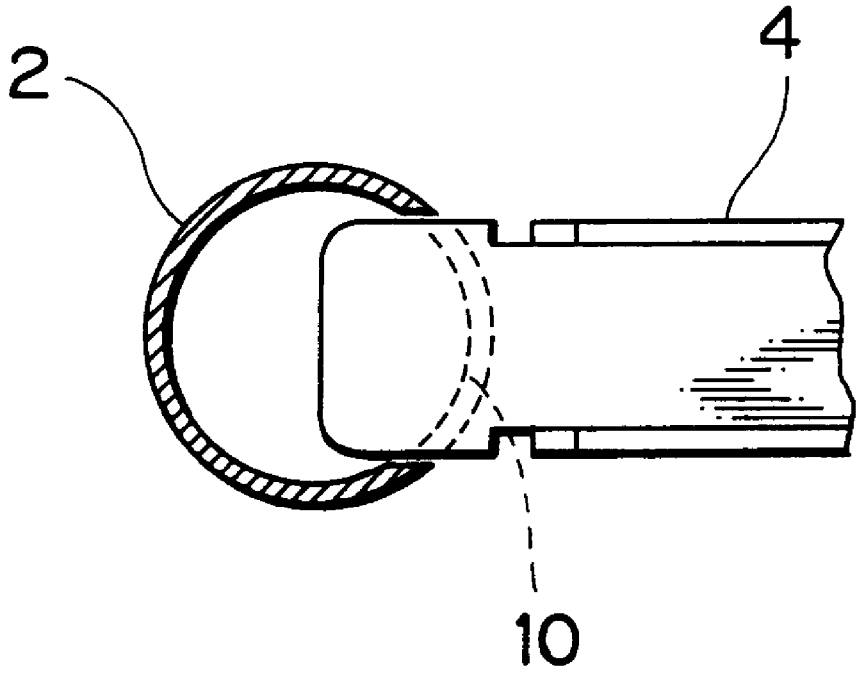
FIG. 7 is a cross-sectional view taken on line VII—VII in FIG. 6.

With reference to FIGS. 4 and 5, the description will be made of another example of position regulating means for regulating the positional relation between both ends of the side plate 14 and the slit hole 20. FIG. 4 shows a state in which one end portion of the side plate 14 has been inserted into the slit hole 20, and FIG. 5 shows a cross-section taken on line V—V in FIG. 4. In this respect, FIG. 4 corresponds to FIG. 2, while FIG. 5 corresponds to FIG. 3, and the relationship between the right-side header pipe 13 and the side plate 14 is omitted as in the same way in FIGS. 2 and 3.

On both sides of both end portions of the side plate 14, there are formed bent tabs or pawls 31 and 31 as position regulating means respectively. In addition, in the middle between both sides of both end portions of the side plate 14, there is provided a convex portion 32 as position regulating means respectively. When both end portions of the side plate 14 have been inserted into the slit holes 20 in the left-side header pipe 12 and the right-side header pipe 13 respectively, the respective pawls 31 on the both sides are bent to abut on the inner sides of the pipe walls of the left-side header pipe 12 and the right-side header pipe 13, and the convex portion 32 abuts on the outside of the pipe wall. This causes the pipe walls of the left-side header pipe 12 and the right-side header pipe 13 to be pinched between the pawls 31 on both sides and the convex portion 32. In this respect, it may be possible to form the convex portion 32 after the side plate 14 is inserted.

The left-side header pipe 12 and the right-side header 13 are interposed between three points: pawls 31 and 31 at two places provided on both sides of both end portions of the side plate 14 respectively and the convex portion 32. To this end, the angles of installation of the side plate 14 to the left-side header pipe 12 and the right-side header pipe 13 are regulated by pinching the pipe wall between three points: pawls 31 and 31 at two points of each end portion and the convex portion 32. Also, the insertion depth of the side plate 14 into the slit hole 20 is regulated by pinching the pipe wall between three points: pawls 31 and 31 at two points of each end portion and the convex portion 32. This causes the side plate 14 to be installed to the left-side header pipe 12 and the right-side header pipe 13 in a state free from errors.

In this respect, the position regulating means for regulating the inserted state of the side plate 14 into the left-side header pipe 12 and the right-side header pipe 13 is not limited to such position regulating means as shown in FIG. 2 or FIG. 5, but it is also possible, for example, to provide the slit 20 side with bent tabs or pawls and to provide the side plate 14 side with cut-outs, holes or the like in which the pawls fit so as to regulate the inserted state of the side plate 14 into the left-side header pipe 12 and the right-side header pipe 13 by the fitting of the two.

According to a heat exchanger of the present invention, in a heat exchanger in which both end portions of the side plate are inserted into the end portions of a pair of header pipes respectively, a large number of tubes are provided between the pair of header pipes, between the respective side plates, and fins are arranged between the large number of tubes, the position regulating means for regulating the inserted state of the side plate into the header pipe are provided between the pair of header pipes and both end portions of the side plates. Therefore, the inserted state of the side plate into the header pipe is regulated by the position regulating means. As a result, it becomes possible to accurately install the side plate to the header pipes in a state free from improper joining and errors, and the header pipes are accurately positioned, thus eliminating any possibility of causing obstruction to the piping or the like.

Since the position regulating means is composed of a pair of pawls provided on both sides of both end portions of the side plate respectively, for pinching the header pipe wall therebetween; and is composed of pawls provided on both sides of both end portions of the side plate respectively, for abutting on the inner wall of the header pipe, and a convex portion provided in the middle between both sides of both end portions of the side plate for abutting on the outer wall of the header pipe to pinch the header wall with the pawls, therefore, it is possible to regulate the inserted state of the side plate into the header pipe with extremely simple structure without increasing the number of parts.

It is to be understood that the invention is by no means limited to the specific embodiments which have been illustrated and described herein, and that various modifications thereof may indeed be made which come within the scope of the present invention as defined by the appended claims.

what is claimed is:

1. A heat exchanger in which both end portions of a pair of side plates are inserted into end portions of a pair of header pipes respectively, a plurality of tubes being provided between said pair of header pipes and between said side plates, and fins are arranged between said plurality of tubes: wherein, position regulating means for regulating an inserted state of said side plates into said pair of header pipes is provided between said pair of header pipes and both end portions of said side plates respectively, said position regulating means including at least one bent tab formed on each of said pair of side plates.

2. The heat exchanger as defined in claim 1, wherein said position regulating means is a pair of said bent tabs provided on both sides of both end portions of said side plates respectively, for pinching the wall of said pair of header pipes therebetween.

3. The heat exchanger as defined in claim 1, wherein said position regulating means is composed of said bent tabs provided on both sides of both end portions of said side plates respectively, for abutting on the inner wall of said pair of header pipes, and a convex portion provided in the middle between both sides of both end portions of said side plates, for respectively abutting on the outer wall of said header to pinch the outer wall of said pair of header pipes with said bent tabs.

4. The heat exchanger of claim 2, wherein said bent tabs are formed by cut edges of said side plates.

5. The heat exchanger of claim 3, wherein said bent tabs are formed by bent edges of said side plates.

6. A heat exchanger, comprising:

a pair of side plates having first and second end portions, respectively;

a pair of header pipes connected to said first and second end portions of said side plates, respectively;

a plurality of tubes provided between said pair of side plates and said pair of header pipes; and position regulating means for regulating the connection between said pair of header pipes and said pair of side plates, said position regulating means including at least one bent tab formed on each of said pair of side plates.

7. The heat exchanger of claim 6, wherein the end portions of said side plates are inserted into slit holes provided in said pair of header pipes.

8. The heat exchanger of claim 7, wherein said position regulating means includes two pairs of said bent tabs at each end portion of said pair of side plates, respectively.

9. The heat exchanger of claim 8, wherein said bent tabs are formed by cut edges of said side plates.

10. The heat exchanger of claim 8, wherein said two pairs of bent tabs further comprise a first pair of bent tabs on an inside surface of a wall of each of said pair of header pipes, respectively, and a second pair of bent tabs on an outside surface of said wall of each of said pair of header pipes, respectively, said first and second pairs of bent tabs pinching said wall of each of said pair of header pipes therebetween.

11. The heat exchanger of claim 7, wherein said position regulating means includes a pair of pawls and a convex portion at each end portion of said pair of side plates, respectively.

12. The heat exchanger of claim 11, wherein said pawls are formed by bent portions of said side plates.

13. The heat exchanger of claim 11, wherein said pair of pawls is on an inside surface of a wall of each of said pair of header pipes, respectively, and said convex portion is on an outside surface of said wall of each of said pair of header pipes, respectively, said pair of pawls and said convex portion pinching said wall of each of said pair of header pipes therebetween.

14. A heat exchanger in which both end portions of side plates are inserted into end portions of a pair of headers respectively, a large number of tubes being provided between said pair of headers between said side plates, and fins are arranged between said large number of tubes: wherein, position regulating means for regulating an inserted state of said side plate into said header is provided between said pair of headers and both end portions of said side plates respectively, said position regulating means is composed of pawls provided on both sides of both end portions of said side plates respectively, said position regulating means is composed of pawls provided on both sides of both end portions of said side plates respectively, for abutting on the inner wall of said header, a convex portion provided in the middle between both sides of both end portions of said side plates, for abutting on the outer wall of said header to pinch the outer wall of said header with said pawls.

15. The heat exchanger of claim 14, wherein said pawls are formed by a bent portion of said side plates.

16. A heat exchanger, comprising:

a pair of side plates having first and second end portions, respectively, a pair of headers connected to said first and second end portions of said side plates, respectively, a plurality of tubes provided between said pair of side plates and said pair of headers; and position regulating means for regulating the connection between said pair of headers and said pair of side plates, said position regulating means includes a pair of pawls and a convex portion at each end portion of said pair of side plates, respectively.

17. The heat exchanger of claim 16, wherein said pawls are formed by bent portions of said side plates.

18. The heat exchanger of claim 16, wherein said pair of pawls is on an inside surface of a wall of each of said pair of headers, respectively, and said convex portion is on an outside surface of said wall of each of said pair of headers, respectively, said pair of pawls and said convex portion pinching said wall of each of said pair of headers therebetween.

* * * * *